US006893190B2

(12) United States Patent
Macrea et al.

(10) Patent No.: US 6,893,190 B2
(45) Date of Patent: May 17, 2005

(54) METHOD AND STRUCTURE FOR CONNECTING A FLOATING STRUCTURE WITH ROPE ANCHOR LINES TO THE SEABED

(75) Inventors: Michael Macrea, Villefranche sur Mer (FR); René Perratone, Menton (FR); Jack Pollack, Monaco (MC)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 10/343,645

(22) PCT Filed: Aug. 1, 2001

(86) PCT No.: PCT/EP01/08894

§ 371 (c)(1),
(2), (4) Date: May 5, 2003

(87) PCT Pub. No.: WO02/10010

PCT Pub. Date: Feb. 7, 2002

(65) Prior Publication Data

US 2003/0170076 A1 Sep. 11, 2003

(30) Foreign Application Priority Data

Aug. 1, 2000 (EP) ..... 00202743

(51) Int. Cl.[7] ..... B63B 21/00; B63B 22/02

(52) U.S. Cl. ..... 405/209; 405/206; 405/195.1; 405/224.2; 114/230.1; 166/354

(58) Field of Search ..... 405/195.1, 203, 405/205, 206, 209, 224.2; 114/230.1, 231, 230.13, 230.2, 230.21, 230.22; 166/354, 350, 367

(56) References Cited

U.S. PATENT DOCUMENTS

| | | | | | |
|---|---|---|---|---|---|
| 4,067,282 | A | * | 1/1978 | Guinn et al. | 114/230.2 |
| 4,597,350 | A | * | 7/1986 | Mott | 114/230.13 |
| 5,159,891 | A | * | 11/1992 | Lohr et al. | 114/230.2 |
| 6,666,624 | B2 | * | 12/2003 | Wetch | 405/205 |
| 6,685,519 | B1 | * | 2/2004 | Bech et al. | 114/231 |
| 6,719,497 | B1 | * | 4/2004 | Pollack et al. | 405/224 |

FOREIGN PATENT DOCUMENTS

| | | | |
|---|---|---|---|
| GB | 2061850 | * | 5/1981 |
| GB | 2 258 852 | | 2/1993 |

* cited by examiner

*Primary Examiner*—Jong-Suk Lee
(74) *Attorney, Agent, or Firm*—Young & Thompson

(57) ABSTRACT

A method of connecting a first floating structure to the seabed, includes the steps of: providing a second floating structure, anchored to first and second anchoring points respectively on the sea bed via at least two anchor lines, attaching the second floating structure to the first structure via a pulling device, on the side of the first anchor line, displacing the first floating structure away from the second anchoring point towards the first anchoring point, disconnecting the first anchor line from the second floating structure while maintaining a pulling force on the second anchor line via the pulling device, and attaching the first anchor line to the first floating structure. By interconnecting a temporary buoy to the vessel to be anchored via a tension member, the anchor lines of the buoy and the vessel can remain under tension at all times whereby damage to the anchor lines is prevented.

15 Claims, 5 Drawing Sheets

METHOD AND STRUCTURE FOR CONNECTING A FLOATING STRUCTURE WITH ROPE ANCHOR LINES TO THE SEABED

BACKGROUND OF THE INVENTION

The invention relates to a method and structure for anchoring a floating structure, such as a hydrocarbon storage and/or processing vessel, a tanker, barge, SPAR buoy or a mooring buoy with anchor lines containing large rope sections to the sea bed.

Upon installation of an offshore project, floating production storage and offloading vessels (FPSO), floating production, drilling, storage and offloading vessels (FPDSO), floating production, workover, storage and offloading vessels (FPWSO), Spar buoys, catenary anchor leg mooring (CALM) buoys, semi-submersibles or other hydrocarbon storage and/or processing vessels are moored to the sea bed via anchor lines, and are connected to a subsea oil or gas well via one or more product risers. Especially in water depths of over 300 m, rope anchor lines are used, such as steel wire rope or polyester rope. If these anchor lines become slack during installation, they can bend and kink, such that the anchor lines are weakened, or may even break. Placing the rope anchor lines on the seabed during installation is not preferred in view of possible damage to the anchor lines.

Upon installation, a critical time path can be followed in which the anchor lines, product risers and hydrocarbon production and/or storage vessel need all be installed and hooked up simultaneously prior to production. Alternatively, first installing the anchor lines, followed by hook up of the vessel to the anchor lines and product risers, results in the problem of temporary abandonment and recovery of the anchor lines and consequent damage to the anchor lines.

SUMMARY OF THE INVENTION

It is therefore an object of the present invention to provide a method of connecting a floating structure to the seabed with anchor times containing tensioned rope sections and preventing damage to the anchor lines.

It is a further object to provide a method of connecting a floating structure to the seabed with anchor lines containing large rope sections, while the anchor lines remain in a tensioned state.

It is in particular an object of the present invention to provide an installation method and structure for a hydrocarbon production and/or storage vessel, allowing connection of mooring legs and risers to a vessel in one continuous operation.

It is again an object of the present invention to provide a method and structure by which different floating structures can be connected to the seabed, and/or can mutually be connected in an efficient manner.

It is an another object of the present invention to provide a method of installing a vessel in deep water, such as in water depths of 300 m and more, using rope anchor lines.

Thereto the method according to the present invention comprises the steps of:

providing a second floating structure, anchored to first and second anchoring points respectively on the sea bed via at least two anchor lines, each anchor line comprising a large tensioned rope section, attaching the second floating structure to the first structure via a member on the side of the first anchor line, disconnecting the first anchor line from the second floating structure and attaching the first anchor line to the first floating structure, while maintaining the positions of the first and second floating structure relative to each other via the member.

The term "floating structure" as is used herein is intended to comprise, barges, FSO's, FPSO's, FPDSO's, FPWSO's, temporary buoys, CALM buoys, Spar buoys and mooring buoys, semi-submersibles, shuttle tankers, etc.

The second floating structure may for instance be a temporary buoy or barge which is anchored to the seabed. One or more product risers may be connected to the temporary buoy.

By interconnecting the temporary buoy and the vessel to be anchored via a tension member such as a hawser, the anchor lines on the buoy and vessel can remain under tension after they are transferred from the buoy to the vessel. Hereby damage to the anchor lines is prevented, without the need for temporarily abandoning the anchor lines on the seabed. The method allows the use of synthetic ropes like polyester ropes and is therefore especially suitable for deep water. When the anchor lines and product risers have been transferred from the temporary buoy to the vessel, the temporary buoy can be removed from the installation site.

By using a temporary installation buoy or barge, simultaneous hook up and installation of the vessel, such as an FPSO can be carried out upon arrival of the FPSO on the site, independently of the construction schedule of the FPSO. Hereby the time path of fabrication and installation of the risers and the FPSO is made more flexible and less critical in terms of first oil and contingencies, and the installation costs can be reduced.

By the method according to the present invention, the pre-installation of the anchor lines to a temporary buoy or barge, allows removing of more than 90% of the permanent stretch from the anchor lines before they are transfer to and hooked-up on a permanent floating structure. This can be done by tensioning cycling of the anchor lines during installation, leaving the anchor lines on the temporary buoy sufficiently long time and by re-tensioning the anchor lines on said buoy to remove the permanent stretch. To this end the anchor lines on the temporary buoy can be equipped with a chain part for progressively pulling in the anchor lines on the temporary buoy, which chain parts may later be re-used. The second vessel can after removal of the stretch from the anchor lines be attached to these anchor lines without any chain parts to be pulled in to compensate for length variations, whereby the need for tensioning operations and chain adjustment equipment or even a heavy chain table on the second vessel, is obviated.

The floating structure to be anchored to the sea bed may be a mooring buoy for mooring to for instance an FPSO, wherein the anchor lines of the temporary buoy are such as to be adapted to anchoring the mooring buoy and the vessel moored thereto.

The method of the present invention may also be used for change out of an already moored buoy or vessel. The anchor lines and product risers of such a vessel, such as a turret or spread moored vessel, may be connected to a temporary buoy or barge, for exchange or maintenance of the vessel.

Also, a spread moored or turret moored vessel may be connected to a mooring buoy for shuttle tankers via a horizontal duct, one end of which is attached to a temporary buoy. The temporary buoy also carries one or more product risers and anchor lines, which are all transferred to the spread moored or turret moored vessel by the method of the present invention.

Finally, the method may be used to connect a shuttle tanker to a permanently moored FPSO for tandem offloading or for side by side offloading.

BRIEF DESCRIPTION OF THE DRAWINGS

Some embodiments of the method according to the present invention will by way of example be explained in detail with reference to the accompanying drawings. In the drawings.

DESCRIPTION OF THE PREFERRED EMBODIMENTS

Figure 1A:
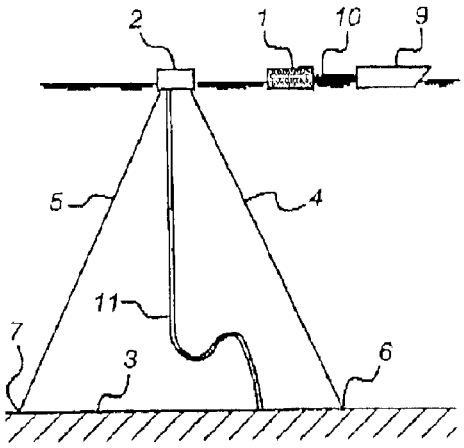
FIGS. 1*a*–1*f* show the different stages of anchoring a permanent mooring buoy using a temporary buoy or barge according to the present invention.

FIG. 1 shows an installation method for installing a vessel such as a mooring buoy 1 or an FPSO. In FIG. 1*a* is a temporary buoy 2 moored to the seabed 3 via polyester anchor lines 4,5 to anchoring points 6,7. The anchor lines 4,5 may be between 300 and 5000 m in length. The buoy 2 will be of the dimensions suitable of supporting the suspended weights of the mooring lines, risers and other equipment i.e. winches, and power-packs. A product riser 11 is connected on one end to a sub-sea hydrocarbon well, and is with its free end connected to the buoy 2. A tug 9 pulls the mooring buoy 1 by a hawser 10 to a position close to the stock buoy 2. Next, the mooring buoy 1 is connected to the stock buoy 2 via a member which can take up tension forces, for example a hawser 13. The hawser 13 could have a length of at least 20 meter. For redundancy or stability reasons it could be necessary to have more than one hawser between the floating bodies.

Figure 1B:
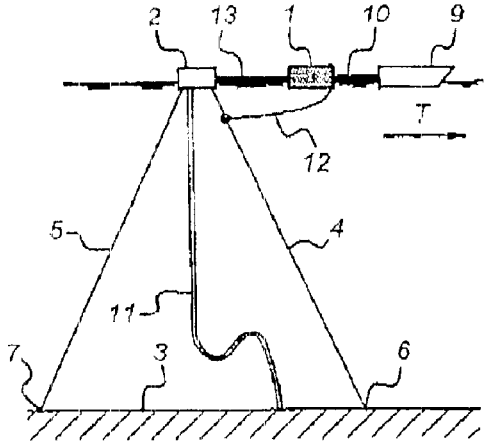

As is shown in FIG. 1*b*, the tug avoid collision of the buoys and keep buoy 1 away from the second anchor point 7 by pulling in the direction of the arrow T. Next, the anchor line 4 is detached from the buoy 2 and re-attached to the mooring buoy 1. The transfer of the anchor line 4 can be done via a cable 12 connected to a winch on buoy 1 and which is connected to the anchor line 4 via an connection point like a tri-plate or connected directly to a shackle of an upper chain section of the anchor line 4. The anchor line 4 is connected to a winch on buoy 2 and the anchor line 4 is released while at the same moment line 12 is pulled in on buoy 1, which will transfer the anchor line 4 to the buoy 1. Alternatively the cable 12 can be pulled on board of the buoy 1 tug 9 which keeps the buoy 1 in place and afterwards the anchor line 4 can be transferred to the buoy 1. The anchor line 4 and/or the cable 12 can also be pulled in by a tug not connected to any one of the buoys, and transfer the anchor line 4 to buoy 1.

Figure 1C:
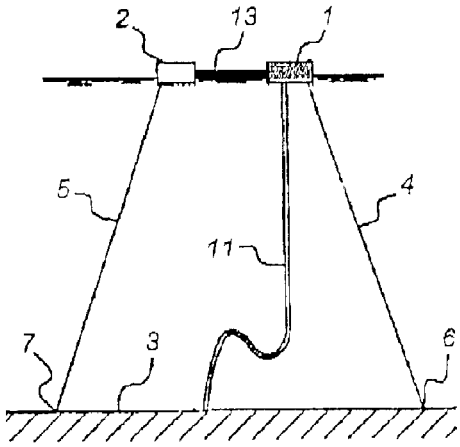

During the operation of transferring the first anchor line or lines, the tug 9 can exert a pulling force on the buoy 2 in the direction of the arrow T to maintain the positions of the buoys relative to each other and to the seabed and avoiding the anchor line 5 to get to slack, kink or touch the seabed (see in FIGS. 1*b* and 1*c*).

After the first anchor line or lines are transferred, more anchor lines can be transferred without a tug pulling the buoy 1 as the whole mooring system will be basically a stabilized system due to the tension member 13 between the buoys, as is shown in FIG. 1*c*. It is preferred to connect the anchor line 4 or the first anchor lines to the mooring buoy 1 in the part that is past the centerline away from the buoy 2. The rest of the anchor lines can now be transferred from buoy 2 to buoy 1 except for a last anchor line 5 which will keep the mooring configuration stable.

The risers 11 will be transferred from temporary buoy 2 to buoy 1 in the same manner as the anchor lines. This transfer can be performed before the last anchor line when is transferred and preferably when there a for example an equal number of anchor lines connected to each buoy (when the mooring configuration of the interconnected buoys 1,2 is the most stable).

Figure 1D:
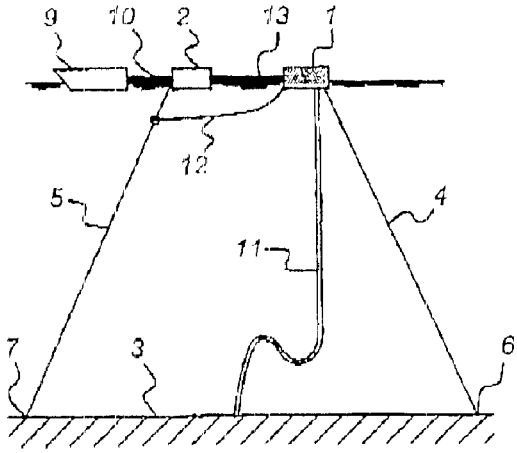
Figure 1E:
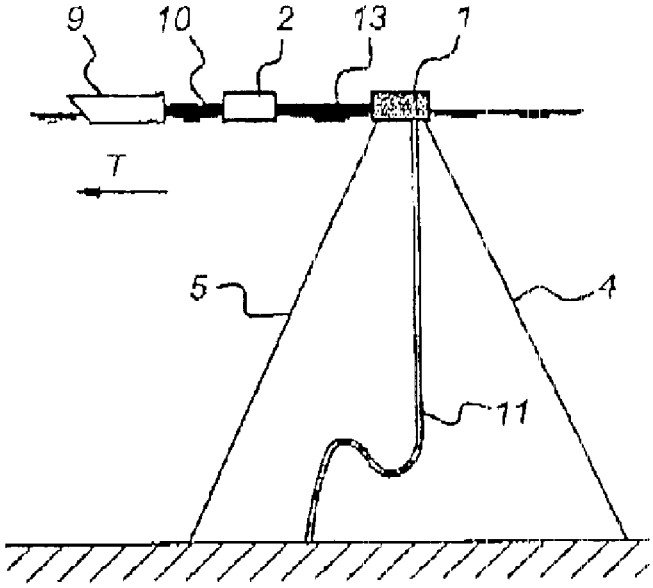

Before the last anchor line or lines are transferred, the hawser 10 is detached from the mooring buoy 1, and is attached to the temporary or stock buoy 2, on the opposite side of the transferred anchor line 47 as is shown in FIG. 1*d*. The tug maintains a putting force, such as for instance 1 ton on the temporary buoy 2, such that the anchor line 5 can be disconnected and transferred to the mooring buoy 1, while keeping both buoys in position, as shown in FIG. 1*e*. After all the anchor line are transferred using one of the earlier mentioned methods, the hawser 13 is disconnected and the temporary buoy 2 is removed from the site by the tug 9.

During the installation or anchor line transfer procedure, the anchor fines 4,5 are maintained at such a tension that they do not become to slack so that they can touch the seabed and the tension does not fall below the suppliers recommended value, e.g. 15% of the minimum breaking load.

Figure 1F:
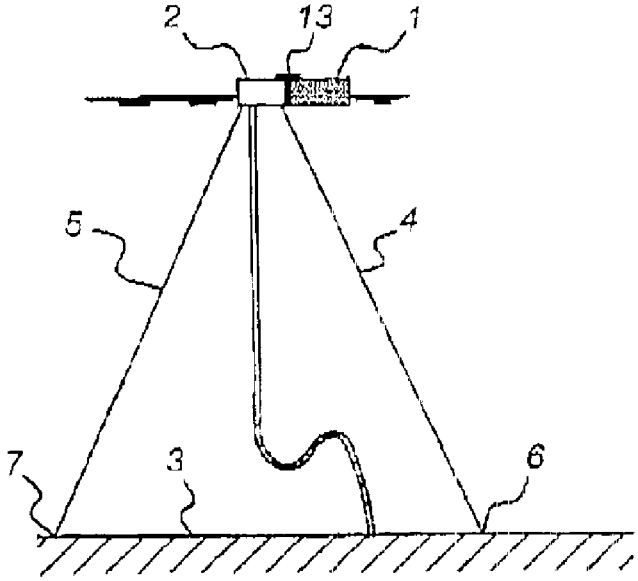

FIG. 1*f* shows a situation which is preferable for small size buoy change out. The permanent mooring buoy 1 is moored via fenders side by side against the temporary buoy 2 with at least one tension member 13, which connect the buoys. In this configuration there is no need to pull on one of the buoys with a tug boat to avoid collision and/or to maintain the relative positions of both buoys as the relative positions of the buoys is secured by the tension member or hawser 13. The anchor lines 4 and 5 can be transferred directly from the temporary buoy 2 to the permanent buoy 1 (or reverse).

The same procedure as described with respect to FIGS. 1*a*–1*f* can be used to chance out a permanent mooring buoy 2, with a temporary or a new mooring buoy 1, for maintenance or repair purposes.

Figure 2:
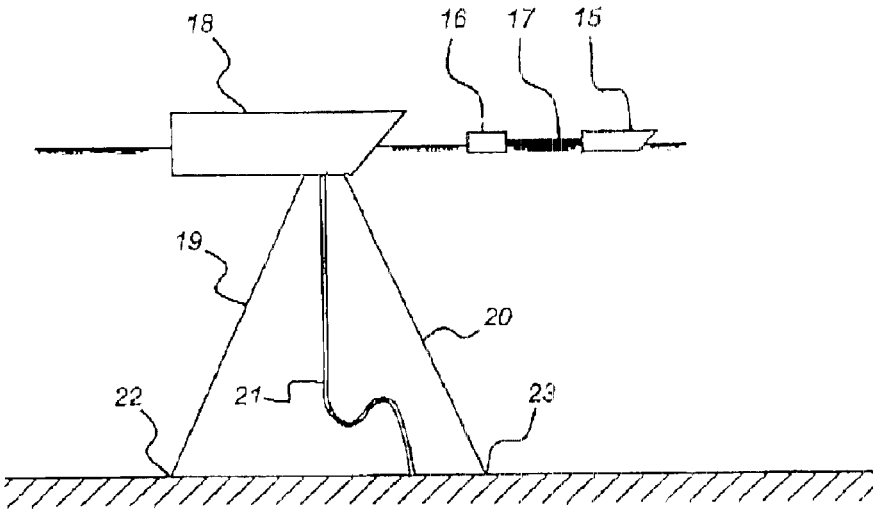
FIG. 2 shows a method of change out of a vessel by a temporary buoy.

FIG. 2 shows a spread moored or turret moored vessel 18, which is connected to the sea bed via anchor lines 19,20 to anchor points 22, 23. A number of product risers 21 are connected to the vessel 18. The vessel is disconnected from the risers 21 and the anchor lines 19,20 in the same way as described for FIGS. 1*a*–1*e*, the risers and anchor lines being connected to a temporary buoy or barge 16, which is attached to tug 15 via hawser 17.

Figure 3:
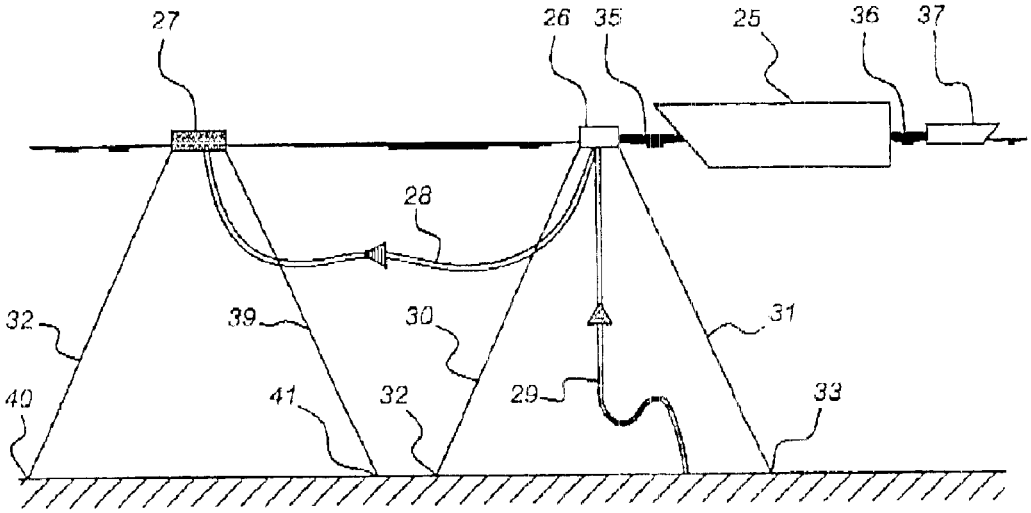
FIG. 3 shows an installation method of a mid depth transfer duct according to the present invention.

FIG. 3 shows a method of installation of a mid water pipe, of the type as described in WO99/62762 in the name of the applicant. A mooring buoy 27 for offloading to a shuttle tanker is anchored to the seabed at anchor points 40,41 via anchor lines 35,39, and carries the end of a substantially horizontal transfer duct 28. The other end of the duct 28 is carried by temporary buoy or barge 26. The buoy 26 is attached to the seabed via anchor lines 30,31, extending to anchor points 32, 33. One or more product risers 29 are attached to the buoy 26. A vessel 25 to be spread or turret moored is connected to the buoy 26 via hawser 35. The vessel 25 is attached to tug 37 via hawser 36. The vessel 25 is anchored to anchor lines 30,31 and is connected to riser 29 in the same way as described in FIGS. 1*a*–1*e*. The buoy 27 may be installed in the same way.

Figure 4A:
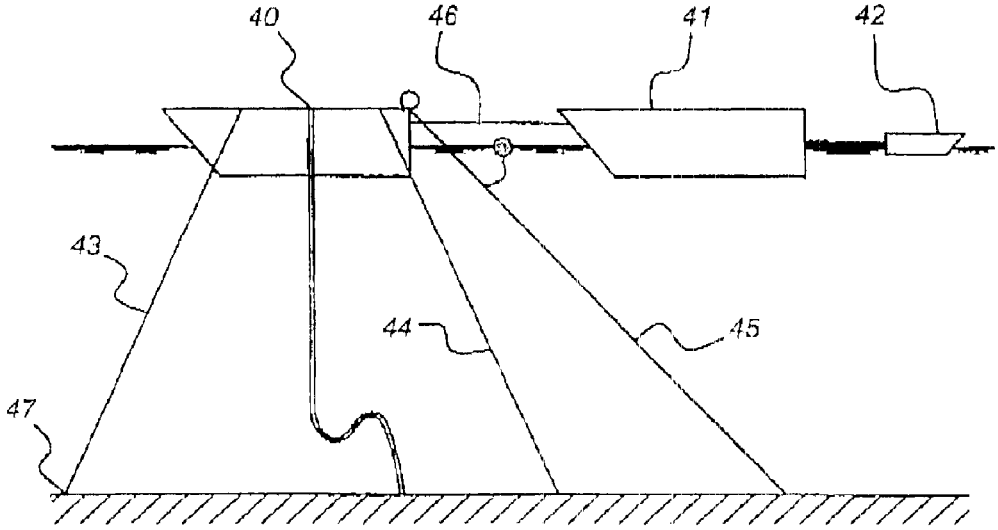
FIGS. 4*a* and 4*b* show an installation method of a shuttle tanker for tandem offloading, FIG. 5*a* show a side view of a barge for temporary mooring purposes.
Figure 4B:
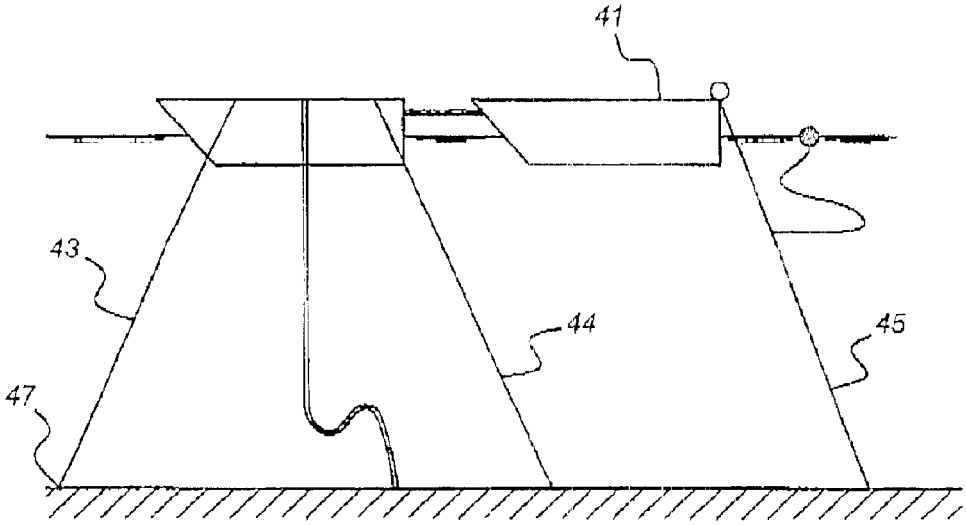

In FIG. 4*a* a shuttle tanker 41 is moored to the stern of vessel 40 via a hawser 46. Tug 42 pulls the tanker 41 in the direction indicated by the arrow T, so that the relative positions of both vessels will be maintained. The anchor line 45 is thereafter detached from the vessel 40, such as shown in FIG. 4*b*, and is transferred to the shuttle tanker 41 to obtain the tandem offloading configuration of FIG. 4*b*.

Basically the same procedure can be used for a side by side mooring configuration of two vessels where at least two relative long hawsers function as tension members between the vessels (not shown). In this case one or more tugboats are pulling one vessel sideward away from the moored vessel and thereafter one or more stern and one bow anchor lines are transferred from the moored vessel to the other vessel.

Figure 5A:
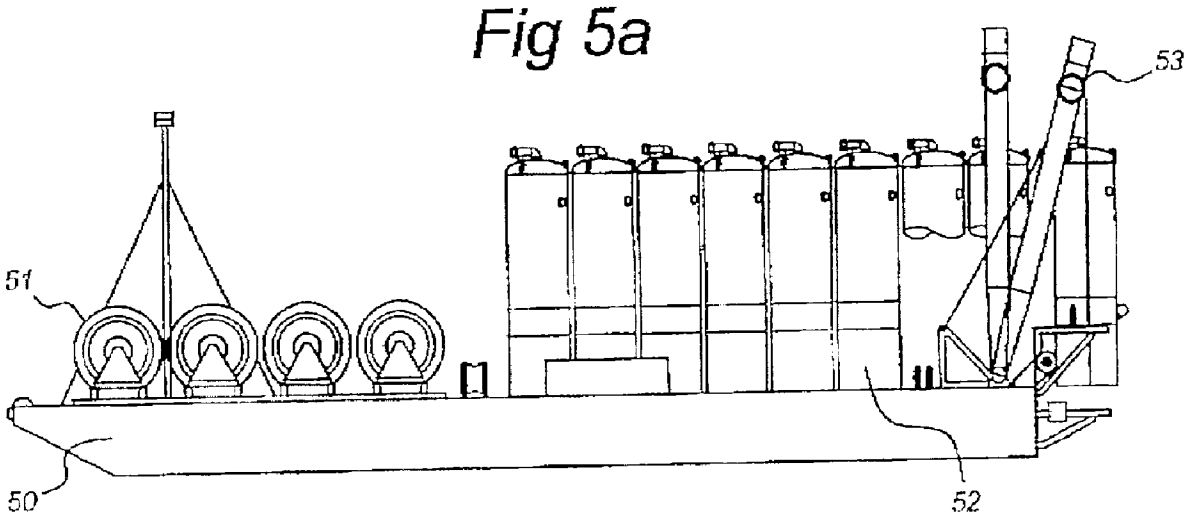
FIG. 5*b* shows a top view of the barge of FIG. 5*a*.
Figure 5B:
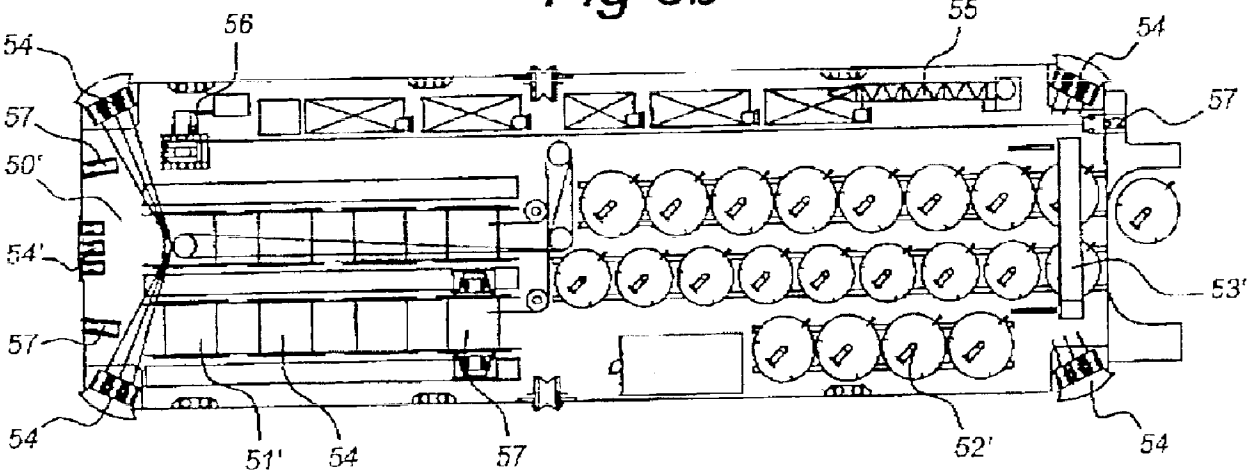

Finally, FIGS. 5*a* and 5*b* show a special designed barge 50, 50' for temporary mooring purposes. The barge comprises connection points 54, 54' for one or more mooring lines at the corners of the barge. There are one or more connection points 57 for connecting hawsers to the barge. The barge has a deck storage capacity for reels 51, 51' with mooring ropes, a reel motor, a reel drive system and multiple anchors 52, 52' which for example could be suction anchors held in a skidding system. The barge could also have lifting means 53, 53', 55 to lift the anchor from the deck and lower the anchor with the rope from the mooring rope reel to the seabed, but this lifting and lowering could also be done by a separate installation vessel. The barge comprises also a winch, for example a 200 tons winch, for lowering, (cycle-) tensioning and re-tensioning the installed mooring lines connected to the barge 50, 50'. The (cycle-) tensioning and re-tension can take place during installation of the moorings lines and/or in time when all the mooring lines are installed. This will remove all or most of the permanent stretch from the mooring lines before the mooring lines are transferred and hooked-up to a permanent floating structure. The winch can tension and/or re-tension each anchor line apart or groups of anchor via a deck sheave construction. A barge with this equipment and a deck space for 20 suction anchors and 8 reels for mooring lines could be for example 90 meters long and 25 meters width. The barge could have any shape and could for example also be a special equipped installation vessel.

What is claimed is:

1. A method of connecting a first floating structure (1, 16, 25, 41) to the sea bed, comprising the steps of:

providing a first floating structure floating on the sea;

providing a second floating structure (2,18, 26, 40), anchored to first and second anchoring points (6, 7; 22, 23; 32,33;47) respectively on the sea bed via at least two anchor lines (4,5; 19, 20; 30,31;43,45), each anchor line comprising a large tensioned rope section and being with a top part connected to the second floating structure;

attaching the second floating structure to the first floating structure via a member (13, 24, 35, 46), on the side of the first anchor line; and disconnecting the top part of the first anchor line (4,20, 31,45) from the second floating structure (2,18, 26, 40) and attaching the top part of the first anchor line (4,20,31,45) to the first floating structure_(1, 16, 25, 41) while maintaining the position of the first and second floating structures relative to each other by exerting a pulling force on the second anchor line (5, 19, 30, 43) of the second floating structure.

2. The method according to claim 1, comprising the step of disconnecting the second anchor line (5,19,30,43) from the second floating structure (2,18,26, 40) and connecting it to the first floating structure (1,16,25, 41), while maintaining the position of the first and second floating structure relative to each other via the member (13,24, 35,46).

3. The method according to claim 1, wherein the first anchor line (4,20,31,45) is attached to the first floating structure (1,16,25,41) in the part past the centerline away from the second floating structure (2,18,26,40) so that the member (13,24,35,46) will be tensioned.

4. The method according to claim 1, wherein the second floating structure comprises at least one product riser (11, 21,29) extending between a sub sea hydrocarbon structure and the second floating structure (2,18,26,40), which product riser is decoupled from the second floating structure (2,18,26,40) and is coupled to the first floating structure (1,16,25,41).

5. The method according to claim 4, wherein the anchor lines are left to stretch and are re-tensioned on the second floating structure (2,18,26,40) at least one time, before transferring the anchor lines to the first floating structure (1,16,25,41).

6. The method according to claim 1, wherein the anchor lines comprise polyester rope.

7. The method according to claim 1, the first floating structure comprising a mooring buoy (1,16) or a hydrocarbon storage and/or processing vessel (25), the second floating structure (2,18,26) being removed after transfer of the anchor lines to the first floating structure (1,16,25).

8. The method according to claim 1, wherein the first and second floating structures (1,2) each comprise a mooring buoy.

9. The method according to claim 1, wherein the second floating structure (18) comprises a mooring buoy or a hydrocarbon storage and/or processing vessel, the second floating structure being removed after transfer of the anchor lines (19,20) and product riser (21) to the first floating structure (16).

10. The method according to claim 1, wherein the second floating structure comprises a first and second buoy (26,27), each buoy connected to the sea bed via anchor lines (30, 31;38,39) and mutually connected by a submerged transfer duct (28), the first buoy (27) being adapted for mooring to a tanker (25), the second buoy (26) comprising at least one product riser (29) connected to a sub sea hydrocarbon structure, wherein the anchor lines (30,31) and the at least one product riser (29) of the second buoy are transferred to the first floating structure (25).

11. The method according to claim 1, wherein the second floating structure comprises a first and second floating member (26,27), each floating member connected to the sea bed via anchor lines (30,31;38,39) and mutually connected by a submerged transfer duct$_{13}$ (28), the second member (26) comprising at least one product riser (27) connected to subsea hydrocarbon structure, wherein the anchor lines (30,31) and the at least one product riser (29) of the first and second floating members (26,27) are transferred to the first floating structure (25), and to a third floating structure respectively.

12. The method according to claim 1, the second floating structure comprising a hydrocarbon storage and/or processing vessel (40), the first floating structure (41) comprising a tanker, wherein the tension member (46) remains attached to both floating structures (40,41) after transfer of the at least one anchor line (45) from the second floating structure (40) to the first floating structure (41).

13. The method according to claim 1, wherein the relative position of the first floating structure (1,16,25,41) and second floating structure (2,18,26,40) during transfer of at least the first mooring line (4,20,31,45) and the second or last mooring line (5,19,30,43) is ensured by a tug boat (9,15,37, 42) pulling at one of the floating structures via a hawser (10,17,36).

14. The method according to claim 1, wherein the tension member (13,24,35,46) is a hawser of at least 20 meters long.

15. The method according to claim 1, each anchor line comprising a large tensioned synthetic rope section, the method further comprising the steps of:

stretching and re-tensioning the anchor lines of the second floating structure (2,18,26,40) at least one time; and after at least 50% of the permanent stretch of the synthetic rope section is taken out, disconnecting the first anchor line (4,20,31,45) to the first floating structure (1,16,25, 41).

* * * * *